US005413647A

United States Patent [19]

Ablett et al.

[11] Patent Number: 5,413,647

[45] Date of Patent: May 9, 1995

[54] METHOD FOR FORMING A THIN-WALLED COMBUSTION LINER FOR USE IN A GAS TURBINE ENGINE

[75] Inventors: Adrian M. Ablett; Robert Dzugan, both of Cincinnati; Stephen J. Lotz, Loveland, all of Ohio

[73] Assignee: General Electric Company, Cincinnati, Ohio

[21] Appl. No.: 216,596

[22] Filed: Mar. 10, 1994

Related U.S. Application Data

[63] Continuation of Ser. No. 858,273, Mar. 26, 1992, abandoned.

[51] Int. Cl.[6] ..... C21D 9/00

[52] U.S. Cl. ..... 148/539; 148/675; 164/114

[58] Field of Search ..... 420/448; 164/114; 148/539, 675

[56] References Cited

U.S. PATENT DOCUMENTS

| | | | |
|---|---|---|---|
| 2,400,495 | 5/1946 | Ford et al. | 138/177 |
| 3,527,285 | 9/1970 | Webbere | 164/114 |
| 4,621,499 | 11/1986 | Mori et al. | 60/752 |
| 4,646,810 | 3/1987 | Lardellier | 164/98 |
| 4,810,467 | 3/1989 | Wood et al. | 420/448 |
| 5,101,547 | 4/1992 | Tanaka et al. | 164/114 |

OTHER PUBLICATIONS

Metals Handbook, 9th Ed, vol. 15 "Centrifugal Casting" pp. 296–307.

*Primary Examiner*—Deborah Yee

*Attorney, Agent, or Firm*—Jerome C. Squillaro; David L. Narciso

[57] ABSTRACT

A vacuum centrifugally cast combustion liner suitable for use in a gas turbine engine operating at temperatures ranging from ambient up to about 1700° F. is provided. The combustion liner is formed by centrifugally vacuum casting a precipitation hardened nickel-based superalloy having controlled, low amounts of aluminum and titanium. The combustion liner is characterized by a homogeneous grain structure having enhanced strength and creep resistance particularly at elevated temperatures. In addition, the preferred elemental composition, particularly the relatively small amounts of aluminum and titanium, enhance the weldability and overall manufacturability of the combustion liner.

15 Claims, No Drawings

METHOD FOR FORMING A THIN-WALLED COMBUSTION LINER FOR USE IN A GAS TURBINE ENGINE

This application is a continuation of application Ser. No. 07/858,273, filed Mar. 26, 1992, now abandoned.

The present invention relates to a method for manufacturing a thin-walled generally cylindrical-shaped member, suitable for use as a combustion liner within a gas turbine engine. More particularly, this invention relates to the manufacture of such a combustion liner using vacuum centrifugal casting techniques, wherein the combustion liner is formed from a precipitation hardened nickel-base superalloy characterized by high strength at operating temperatures ranging from ambient up to about 1700° F.

BACKGROUND OF THE INVENTION

Gas turbine engines are frequently used in high performance aircraft. The performance requirements for these types of turbine engines are continually being improved, thereby requiring higher operating temperatures. As an example, the combustion chamber, which to date has been required to maintain strength at temperatures up to about 1300°–1400° F., is now being designed to operate at temperatures of about 1600° F. or greater where creep is critical.

In the past, the combustion liners for use within the combustion chamber were manufactured from conventional cobalt-based or nickel-based alloys, such as the widely used Hastelloy X material available from Haynes International Co. These materials were chosen because of their sufficient strength and physical characteristics on conventional cooling ring stiffened designs. These conventional designs are fabricated from sheet stock or alternatively machined from wrought material. However, these techniques can be relatively expensive due to the extensive working required to form the thin-walled cylindrical shape of the combustion liner and because of the number of structural welds required.

Regardless of the method used to form the combustion liners from these conventional materials, a significant shortcoming exists in that these conventional wrought materials do not possess the strength or creep resistance necessary to operate satisfactorily at temperatures of about 1600° F.

High strength, creep-resistant materials are known in the industry which would be suitable for use in the combustion liner at operating temperatures ranging from ambient up to about 1700° F., an example being nickel-based superalloy GTD 222 available from General Electric Company. Such a high strength material is characterized by approximately twice the strength at 1600° F., as compared to the conventional materials currently used to form the combustion liners.

However, until now, there has not been a satisfactory means for manufacturing a thin-walled, close tolerance and cylindrically-shaped combustion liner from this material. The conventional techniques for forming a combustion liner from a cast high strength, high temperature material, such as this, are unacceptable. Acceptable casting methods are unknown. In addition, current technology is unproven with regards to the workability of the material in a wrought condition.

Therefore it would be advantageous to provide means for manufacturing a combustion liner from such a high strength, creep resistant material so as to be useful in the combustion chamber of a gas turbine engine, even when operating at temperatures of about 1700° F. Further, it would be advantageous if such a combustion liner were formed by a method which produced a homogeneous and controlled metallurgical grain structure, so as to optimize the mechanical properties of the material.

SUMMARY OF THE INVENTION

It is therefore an object of this invention to provide a combustion liner suitable for use in a combustion chamber within a gas turbine engine, wherein the combustion chamber may operate at temperatures ranging from ambient up to about 1700° F.

It is a further object of this invention that such a combustion liner be formed of a high strength, creep resistant material by vacuum centrifugal casting methods, so as to produce a homogeneous metallurgical structure that is characterized by enhanced mechanical properties, as compared to conventional manufacturing techniques.

It is yet another object of this invention that such a combustion liner be formed from a precipitation hardened nickel-based superalloy having a preferred composition that facilitates the welding and manufacturability of the combustion liner during its assembly within a gas turbine engine.

In accordance with a preferred embodiment of this invention, these and other objects and advantages are accomplished as follows.

According to the present invention, there is provided a combustion liner suitable for use in a gas turbine engine operating at temperatures ranging from ambient up to about 1700° F. The combustion liner is formed by vacuum centrifugal casting methods from a precipitation hardened nickel-based superalloy characterized by high strength and creep resistance at elevated temperatures, and having a composition including controlled, low amounts of aluminum and titanium, as well as other constituents. The vacuum centrifugally cast combustion liner of this invention has a homogeneous metallurgical grain structure, so as to optimize its high strength and creep resistance at such elevated operating temperatures. In addition, the combustion liner exhibits good weldability and machinability, thereby enhancing overall new component manufacture as well as improving repair of such a liner when removed from service.

The vacuum centrifugally cast combustion liner formed in accordance with the method of this invention overcomes many of the disadvantages associated with conventional practices. Previously, the thin-walled cylindrical shape of the combustion liner could not be formed from this high strength, high temperature material because of the material's inability to be forged or worked in the wrought condition. However, the preferred material has been determined to be readily formed by vacuum centrifugally casting methods.

In addition, the vacuum centrifugal casting process utilized to form the combustion liner from the preferred alloy produces a metallurgically superior product, as compared to other manufacturing methods such as machining the combustion liner from investment castings. The metallurgical structure is characterized by a uniform, fine grain structure having fewer, smaller defects and impurities. The vacuum centrifugal casting method enables the grain size to be better controlled, thereby producing the optimum mechanical properties within the material. Further, when machined, the vacuum centrifugally cast combustion liners are characterized by repeatable, consistent dimensions, which facilitate the overall assembly of these components as compared to the "as cast" surfaces of investment castings.

Other objects and advantages of this invention will be better appreciated from the following detailed description.

DETAILED DESCRIPTION OF THE INVENTION

A thin-walled, close tolerance, cylindrically-shaped, combustion liner is vacuum centrifugally cast from a preferred precipitation hardened nickel-based superalloy having high strength and exceptional creep resistance at elevated temperatures of, for example, 1600° F. or greater, so as to be particularly suited for use in a combustion chamber within a high performance gas turbine engine.

The preferred precipitation hardened nickel-based superalloy of this invention is a high strength material characterized by controlled, low amounts of aluminum (Al) and titanium (Ti) for improved weldability. The Al and Ti are the principal elements which combine with nickel to form the desired amount of gamma prime precipitate, principally $Ni_3(Al,Ti)$. The elements Ni, Cr, W, Mo and Co are the principal elements which combine to form the gamma matrix. The principal high temperature carbide formed is of the MC type, in which M is predominantly Nb, Zr and Ti.

More specifically, a preferred alloy of this type is commercially known as alloy GTD 222 from General Electric Company. The specific nominal preferred composition, in weight percents, of this preferred alloy is listed in Table I.

TABLE I

| | |
|---|---|
| Chromium | 22.2–22.8% |
| Cobalt | 18.5–19.5% |
| Tungsten | 1.8–2.2% |
| Columbium | 0.7–0.9% |
| Tantalum | 0.9–1.1% |
| Titanium | 2.2–2.4% |
| Aluminum | 1.1–1.3% |
| Carbon | 0.08–0.12% |
| Zirconium | 0.005–0.02% |
| Boron | 0.002–0.007% |
| Molybdenum | 0.15% Max. |
| Vanadium | 0.1% Max. |
| Hafnium | 0.15% Max. |
| Nickel | Balance * |

*with incidental impurities.

The composition of this precipitation hardened nickel-based superalloy is preferred because of the tightly controlled, relatively low amounts of aluminum and titanium, which give the alloy the optimum combination of ductility, strength, creep resistance and weldability. These low amounts of aluminum and titanium are sufficient at elevated temperatures to appreciably strengthen the alloy by precipitation hardening, yet still provide acceptable resistance to oxidation over the usable temperature range. However by maintaining their levels within the preferred range, which is relatively low as compared to other nickel-based superalloys, the combustion liner retains relatively good ductility while also being relatively weldable and machinable.

It is to be noted that the elements, within the preferred alloy composition described above in Table I, listed between zirconium and hafnium, inclusive, are normal trace elements found within these types of nickel-based alloys. However, in order to ensure optimum performance of these types of materials, their content (as well as any incidental impurities) must be controlled to the trace amounts shown. For example, zirconium must be controlled so as not to detrimentally influence the weldability of the alloy.

Although the above alloy described in Table I is preferred for formation of the combustion liner by vacuum centrifugal casting methods for use at elevated temperatures of 1600° F. or higher, it is believed that other materials may be employed satisfactorily, including other high strength nickel-based superalloys such as RENE 77, RENE 80 and RENE 125 all available from General Electric Company, INCO 939 available from International Nickel Co. and MAR-M-247 available from Martin Marietta Corp.

A previous shortcoming associated with the preferred alloy was its inability to be forged or worked into a wrought product. Therefore for formation of the combustion liner of this invention, the preferred alloy is cast using vacuum centrifugal casting methods. A variety of complex, generally symmetrical, shapes, including a combustion liner, may be formed in this manner from the preferred composition.

The combustion liner is generally characterized by a thin-walled, close tolerance, cylindrical shape. In a specific example referred to throughout herein, the cylindrically-shaped combustion liner has an inside diameter of approximately 19 inches and a wall thickness of approximately 0.08 inches. Appropriate flanges which may require some machining after casting may be provided on the combustion liner for assembly with the other combustion chamber components. A combustion liner of any practical dimension having an inside diameter ranging from about 12" to 144" and having a wall thickness ranging from about 0.01" to 1" may be vacuum centrifugally cast using the preferred material of this invention. The only limitations are practical considerations with respect to the size of the combustion liner, as well as dimensional considerations. If the diametrical dimensions of the mold are too small, or the wall thickness too great, the centrifugal forces may be sufficiently diminished so as to alleviate the advantages associated with centrifugal casting methods.

In order to prevent oxide formation when working with the preferred alloy, vacuum centrifugal casting methods are employed, which utilize a suitably high vacuum. Alternatively, other inert atmospheres could also be utilized during casting.

The vacuum centrifugal casting is accomplished by providing a mold of the appropriate shape, generally tubular and having a longitudinal axis, for formation of the combustion liner. The mold has at least one open end for entry of the molten alloy. The opposite end of the mold may also be open to allow drainage of the molten material including any impurities, or may be closed with an appropriate end plate. Molds for the production of this type of cylindrically-shaped member are known in the art and will not be discussed further.

The mold is rotated about its longitudinal axis by such means as a variable speed drive assembly. Rotational speed will affect the cooling rate of the molten alloy and therefore the resultant microstructure. Accordingly, the rotational speed employed will vary for each application, such as between about 50 and 1500 rpm, depending on the cast shape and desired metallurgical properties.

Molten alloy of the preferred composition is prepared by melting at a temperature just above its melting temperature of about 2500° F. The molten alloy is introduced into the rotating mold by conventional means, where it is then forced against the inner surface of the mold by centrifugal force. The molten material flows uniformly within the mold and solidifies quickly because of the large relatively cold mass of the mold. Upon solidification, the cast material contracts slightly. The mold may also be slightly preheated to a temperature of a few hundred degrees, so as to alter the cooling rate of the molten alloy if desired. Cooling of the molten alloy will still occur almost instantaneously even with the preheated mold due to the relatively large temperature difference.

The resultant metallurgical microstructure of the material is characterized by a homogeneous fine grain structure due to the rapid cooling of the thin-walled combustion liner. Further, the grain size may be easily controlled by varying the cooling rate of the molten alloy such as by modifying the rotational speed of the mold or by modifying the preheat temperature of the mold. A preferred grain size for the specific example given above is an average grain size of ASTM #3 or finer as established and published by the American Society for Testing and Materials. This ensures optimal mechanical properties of the alloy at the elevated operating temperatures.

At an operating temperature of about 1600° F., the vacuum centrifugally cast combustion liner of the preferred material is characterized by an ultimate strength of at least about 80,000 pounds per square inch (psi) and a yield strength of at least about 70,000 psi, as well as good creep and buckling resistance, as compared to conventional combustion liner materials.

The preferred vacuum centrifugally cast combustion liner also contains a significantly reduced number of non-metallic inclusions, as compared to a conventional cast combustion liner. The inclusions tend to be of a smaller size due to the rapid cooling experienced during the preferred casting process, as well as the centrifugal forces which force lighter non-metallic particles to the inner diameter where they can be subsequently machined away. The dimensions of the preferred combustion liners tend to be repeatedly consistent because of the uniform, rapid cooling of the thin-walled cylindrical shape, thereby minimizing the amount of machining required for subsequent assembly. The consistency of dimensions greatly enhances the subsequent fit and assembly of these liners with the other combustion chamber components.

In summary, the vacuum centrifugally cast combustion liner of this invention formed from the preferred precipitation hardened nickel-based superalloy, having low, controlled amounts of aluminum and titanium, is particularly suited for use in a combustion chamber within a gas turbine engine operating at temperatures ranging from ambient to about 1700° F. or higher. The combustion liner is characterized by sufficient strength and creep resistance, while also being characterized by good manufacturability due to excellent machinability and weldability.

Therefore, while our invention has been described in terms of a preferred embodiment, it is apparent that other forms could be adopted by one skilled in the art, such as by modifying the preferred alloy composition within the preferred ranges; or by substituting other high strength, precipitation hardened nickel-based superalloys; or by modifying the vacuum centrifugal casting steps employed; or by modifying the design of the combustion liner.

In light of the foregoing discussion, it will be apparent to whose skilled in the art that the present invention is not limited to the embodiments, methods and compositions herein described. Numerous modifications, changes, substitutions and equivalents will now become apparent to those skilled in the art, all of which fall within the scope contemplated by the invention.

The invention having thus been described, what is claimed as new and desired to be secured by Letters Patent is:

1. A method for forming a thin-walled combustion liner suitable for use in a gas turbine engine comprising the steps of:

centrifugally casting in an inert atmosphere a molten nickel-base superalloy comprising, by weight, from about 22.2 to about 22.8 percent chromium, from about 18.5 to about 19.5 percent cobalt, from about 1.8 to about 2.2 percent tungsten, from about 0.7 to about 0.9 percent columbium, from about 0.9 to about 1.1 percent tantalum, from about 2.2 to about 2.4 percent titanium, from about 1.1 to about 1.3 percent aluminum, and from about 0.08 to about 0.12 percent carbon, the balance being essentially nickel with incidental impurities;

cooling said molten nickel-base superalloy at a sufficiently rapid rate so as to form a thin-walled, generally cylindrically-shaped combustion liner from said nickel-base superalloy, wherein said nickel-base superalloy of said combustion liner is characterized by a fine, homogeneous microstructure having an average grain size of ASTM #3 or finer which optimizes the mechanical properties to provide improved creep resistance, improved ductility and sufficient improved strength at elevated temperatures, such that said combustion liner is usable at temperatures ranging from ambient up to about 1700° F. and is weldable.

2. A method for forming a combustion liner as recited in claim 1 wherein said cooling step is sufficiently rapid so as to result in an average grain size within said nickel-base superalloy of no greater than about ASTM #3.

3. A method for forming a combustion liner as recited in claim 1 wherein said nickel-base superalloy is precipitation hardenable by the formation of gamma prime precipitates consisting essentially of a $Ni_3(Al, Ti)$ phase.

4. A method for forming a combustion liner as recited in claim 1 wherein said centrifugally cast combustion liner formed from said nickel-base superalloy is characterized by an ultimate strength of about 80,000 pounds per square inch and a yield strength of at least about 70,000 pounds per square inch at a temperature of about 1700° F.

5. A method for forming a combustion liner as recited in claim 1 wherein said combustion liner is characterized by a generally cylindrical shape having an inner diameter ranging from about 12" to 144" and having a wall thickness ranging from about 0.01"0 to 1".

6. A method for forming a combustion liner as recited in claim 1 wherein said molten nickel-base superalloy is at a temperature of at least about 2500° F. upon its introduction into said rotating mold.

7. A method for forming a combustion liner as recited in claim 1 wherein said inert atmosphere is a vacuum.

8. A method for forming a combustion liner suitable for use in a gas turbine engine comprising the steps of:

rotating a mold about its longitudinal axis, and introducing a molten nickel-base superalloy into said rotating mold within an inert atmosphere, said molten nickel-base superalloy comprising, by weight, from about 22.2 to about 22.8 percent chromium, from about 18.5 to about 19.5 percent cobalt, from about 1.8 to about 2.2 percent tungsten, from about 0.7 to about 0.9 percent columbium, from about 0.9 to about 1.1 percent tantalum, from about 2.2 to about 2.4 percent titanium, from about 1.1 to about 1.3 percent aluminum, and from about 0.08 to about 0.12 percent carbon, the balance being essentially nickel with incidental impurities;

said mold rotating at a speed sufficient to rapidly cool said molten nickel-base superalloy upon its introduction within said rotating mold, so as to form a thin-walled, generally tubular-shaped combustion liner from said nickel-base superalloy, wherein said nickel-base superalloy of said combustion liner is characterized by a fine, homogeneous microstructure and sufficient strength at elevated temperatures, such that said combustion liner is usable at temperatures ranging from ambient up to at least about 1600° F.

9. A method for forming a combustion liner as recited in claim 8 wherein said mold is rotated to cool said molten nickel-base superalloy at a speed sufficient to produce a homogeneous microstructure having an average grain size of no greater than about ASTM #3.

10. A method for forming a combustion liner as recited in claim 8 wherein said mold is rotating at a speed ranging between about 50 and 1500 revolutions per minute.

11. A method for forming a combustion liner as recited in claim 8 wherein said nickel-base superalloy is precipitation hardenable by the formation of gamma prime phase within a gamma matrix.

12. A method for forming a combustion liner as recited in claim 8 wherein said combustion liner formed from said nickel-base superalloy is characterized by an ultimate strength of about 80,000 pounds per square inch and a yield strength of at least about 70,000 pounds per square inch at a temperature of about 1700° F.

13. A method for forming a combustion liner as recited in claim 8 wherein said combustion liner is characterized by a generally cylindrical shape having an inner diameter ranging from about 12" to 144" and having a wall thickness ranging from about 0.01" to 1".

14. A method for forming a combustion liner as recited in claim 8 wherein said molten nickel-base superalloy is at a temperature of at least about 2500° F. upon its introduction into said rotating mold.

15. A method for forming a combustion liner as recited in claim 8 wherein said inert atmosphere is a vacuum.

* * * * *